US011326280B2

(12) United States Patent
Ellis

(10) Patent No.: US 11,326,280 B2
(45) Date of Patent: May 10, 2022

(54) WOVEN FABRIC SUBSTRATE FOR PREVENTION OF STRUCTURAL DAMAGE TO FUNCTIONAL YARNS CONTAINED THEREIN

(71) Applicant: Inman Mills, Inman, SC (US)

(72) Inventor: Thomas M. Ellis, Seneca, SC (US)

(73) Assignee: Inman Mills, Inman, SC (US)

( * ) Notice: Subject to any disclaimer, the term of this patent is extended or adjusted under 35 U.S.C. 154(b) by 288 days.

(21) Appl. No.: 16/417,696

(22) Filed: May 21, 2019

(65) Prior Publication Data

US 2019/0360131 A1 Nov. 28, 2019

Related U.S. Application Data

(60) Provisional application No. 62/675,353, filed on May 23, 2018.

(51) Int. Cl.
*D03D 1/00* (2006.01)
*D03D 15/00* (2021.01)

(52) U.S. Cl.
CPC ..... *D03D 1/0088* (2013.01); *D03D 15/00* (2013.01)

(58) Field of Classification Search
None
See application file for complete search history.

(56) References Cited

U.S. PATENT DOCUMENTS 4,456,035 A 6/1984 Brüggemann et al.
2009/0137176 A1 5/2009 Okuya et al.

FOREIGN PATENT DOCUMENTS

KR 20140040302 * 4/2014

OTHER PUBLICATIONS

Machine translation of KR20140040302 (Year: 2014).*

* cited by examiner

*Primary Examiner* — Shawn Mckinnon
(74) *Attorney, Agent, or Firm* — Dority & Manning, P.A.

(57) ABSTRACT

A fabric substrate material is provided. The fabric substrate includes at least a first layer and a second layer. The first layer includes a first plurality of non-functional fill yarns and at least one functional fill yarn, and the second layer includes a second plurality of fill yarns. The second plurality of fill yarns and the at least one functional fill yarn exhibit substantially the same compressive strength, compressive resistance, or flexural strength. As such, the functional fill yarn in the first layer is protected from shrinkage or expansion and remains undamaged and functional after the fabric substrate is woven and subsequently handled or processed. The aforementioned practice of reinforcement described in the fill direction of the second layer can also be applied in the warp yarn direction, using the same principles described herein.

17 Claims, 8 Drawing Sheets

WOVEN FABRIC SUBSTRATE FOR PREVENTION OF STRUCTURAL DAMAGE TO FUNCTIONAL YARNS CONTAINED THEREIN

RELATED APPLICATION

The present application claims the benefit of U.S. Provisional Application Ser. No. 62/675,353 having a filing date of May 23, 2018, which is incorporated herein by reference for all purposes.

BACKGROUND

In recent years, there has been rapidly increasing interest in making a full range of textile products that have added functionality, past providing normal cover, comfort, aesthetics, and the conventional or ordinary performance. This added functionality might include examples such as higher visibility, the ability to generate and store electrical power, color change at will, the ability to communicate wirelessly, and the ability to store user information. In order to realize textiles that have improved functionality, it is inherent that advances will be required at the molecular level, the fiber level, the yarn level, and the fabric formation level. At the present stage of technical development, most researchers are focused at the fiber or yarn level.

Therefore, with the advancement of miniaturized electronic components and new polymer chemistries, attempts have been made to incorporate functional fibers and yarns (such as materials that include light emitting diodes (LEDs), photonics, batteries, or other chemical or electronic components) into fabrics to enhance their overall functionality and value. However, one problem with incorporating functional yarns into textile fabrics is that, in general, functional yarns and fibers are physically quite dissimilar from conventional textile yarns and fibers such as cotton and polyester. When these dissimilar materials are incorporated into the same fabric, undesired consequences can result such as differential shrinkage, waviness, puckering, and unwanted textures. Textile fabrics tend to contract during the weaving or knitting process. This contraction, in turn, leads to kinking, bending, and/or breakage of one or more sections of the functional yarn incorporated into the fabric, as the functional yarns (as they exist today) tend to have an increased stiffness or brittleness compared to other conventional yarns in the fabric. As a result of this difference in stiffness or brittleness, the functional yarn can be damaged and no longer useful for its intended advantage. For example, in the case of a functional yarn containing an LED component, the functional yarn would no longer be able to emit light.

Thus, a need exists for a woven fabric construction that, by design, is inherently capable of preventing any type of damage to a functional yarn incorporated therein. There is also a need for a practical method for producing such fabric.

SUMMARY

In one particular embodiment, the present disclosure is directed to a fabric substrate. The fabric substrate includes a first layer, wherein the first layer includes a first plurality of fill yarns and at least one functional fill yarn; and a second layer, wherein the second layer includes a second plurality of fill yarns. Further, the second plurality of fill yarns and the at least one functional fill yarn exhibit substantially the same compressive strength or resistance, flexural strength, or both. In addition, a plurality of warp yarns maintain the first plurality of fill yarns and the at least one functional fill yarn in the first layer and maintain the second plurality of fill yarns in the second layer, wherein the first layer is separated from the second layer.

In another embodiment, the compressive strength or resistance of the second plurality of fill yarns can be from about 70% to about 110% of the compressive strength of the at least one functional fill yarn.

In still another embodiment, the flexural strength of the second plurality of fill yarns can be from about 70% to about 110% of the flexural strength of the at least one functional yarn.

In yet another embodiment, the at least one functional yarn can contain a functional or electronic component, or functional chemistry. For example, the functional or electronic component can include a photonic device, a battery, light emitting diode, or a combination thereof.

In one more embodiment, the at least one functional yarn can have a diameter ranging from about 0.15 millimeters to about 1.25 millimeters.

In an additional embodiment, the first plurality of fill yarns can each have a diameter ranging from about 0.05 millimeters to about 1 millimeter.

In another embodiment, the first plurality of fill yarns can each include non-aromatic polyamide fibers, polyester fibers, polyolefin fibers, cotton fibers, or a combination thereof.

In still another embodiment, the second plurality of fill yarns can each have a diameter ranging from about 0.05 millimeters to about 1 millimeter.

In yet another embodiment, the second plurality of fill yarns can each include a monofilament. For example, the monofilament can be nylon, polyethylene, ultrahigh molecular weight polyethylene, polyvinylidene fluoride, polyester, or a combination thereof. Further, the monofilament can optionally be covered with a textile fiber.

In one more embodiment, a ratio of a diameter of the at least one functional yarn to each of the second plurality of fill yarns can range from about 1.0 to about 1.2.

In an additional embodiment, the plurality of warp yarns can each have a diameter ranging from about 0.05 millimeters to about 1 millimeter. Further, each of the plurality of warp yarns can include a sheath and a core, wherein the sheath can include non-aromatic polyamide fibers, polyester fibers, polyolefin fibers, cotton fibers, polyester, or a combination thereof, and wherein the core can include a glass filament, a monofilament, carbon fibers, or polyester fibers.

In another embodiment, the first layer is can be an exterior-facing layer and the second layer is a body-facing layer.

In one particular embodiment, a fabric product that includes the fabric substrate as defined according to any of the features above is contemplated. Further, the fabric product can be an item of apparel and/or can be a protective, automotive, industrial, medical, or carpeting product.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
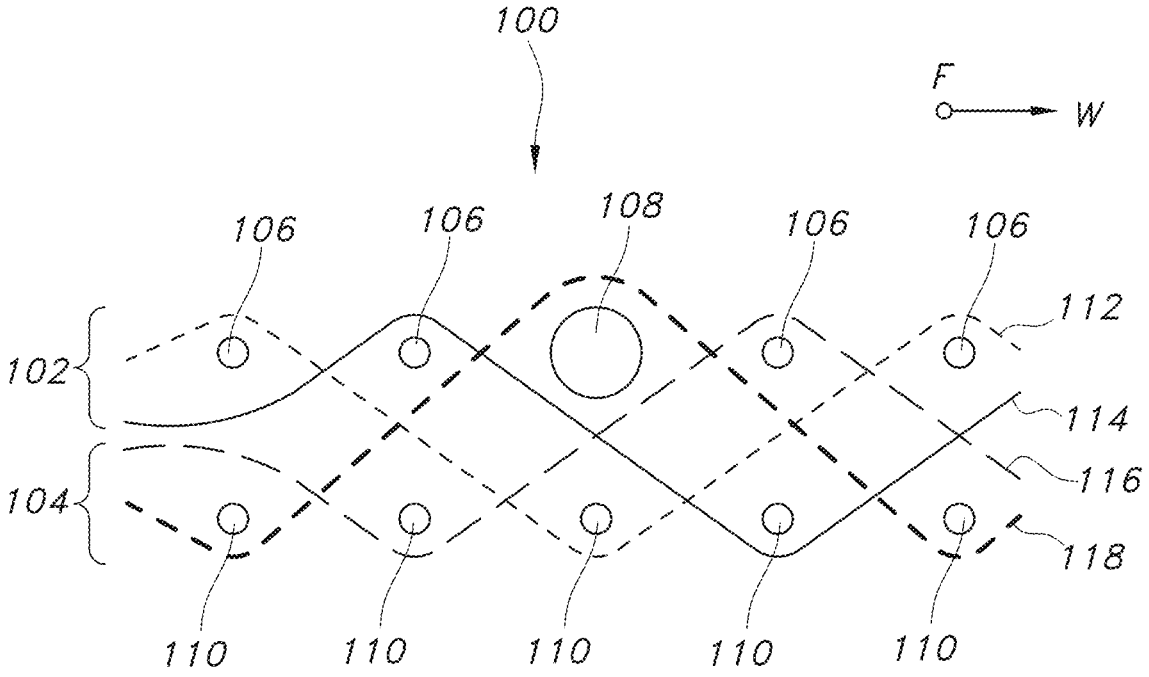
FIG. 1 is a cross-sectional view of a typical embodiment of a fabric substrate made in accordance with the present disclosure taken along the warp direction.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

Generally speaking, the present invention is directed to a fabric substrate that includes a first layer and a second layer. The first layer includes a plurality of non-functional fill (or weft) yarns and at least one functional fill or weft yarn, and the second layer includes a second plurality of fill or weft yarns. The second plurality of fill or weft yarns and the functional fill or weft yarn (from the first layer) exhibit substantially the same compressive strength, flexural rigidity, and tensile properties in general. Given that the yarns in the second layer are non-functional but are physically similar to the functional fill or weft yarn in the first layer, the second layer yarns are present in a sufficient quantity to cause the fabric to be dimensionally stable, which in turn protects the functional fill or weft yarn in the first layer from damage in the form of impact, elongation, or linear compression. As such, the functional fill or weft yarn in the first layer remains undamaged and functional after the fabric substrate is woven, even if the fabric material changes dimensions immediately after weaving, when weaving tensions are released. In addition, a plurality of warp yarns maintain the first plurality of fill yarns and the at least one functional fill yarn in the first layer and maintain the second plurality of fill yarns in the second layer of the fabric substrate.

More specifically, the particular arrangement and materials selected to form the first layer and second layer of the fabric substrate of the present disclosure results in a fabric substrate that is reinforced such that the at least one functional yarn, which is generally more stiff than the other yarns in the first layer, does not bend, kink, or break, where such kinking or breakage could render the functional yarn useless. Instead, the second layer of the fabric substrate (being physically similar to the layer one functional yarn) acts as a reinforcing layer to prevent the fabric substrate from contracting or shrinking, which, in turn, prevents kinking or breakage of the at least one functional yarn in the first layer. Referring now to FIGS. 1-4, the specific components of the fabric substrate 100 are described in more detail.

FIG. 1 shows a cross-sectional view of the fabric substrate 100 along the warp direction W. The fabric substrate 100 can be a woven substrate that includes a first layer 102 and a second layer 104. The first layer 102 can include a first plurality of fill yarns 106 as well as at least one functional yarn 108, while the second layer 104 can include a second plurality of fill yarns 110, where the first plurality of fill yarns 106 and the second plurality of fill yarns 110 can be non-functional. As shown, the first plurality of fill yarns 106, the at least one functional yarn 108, and the second plurality of fill yarns 110 can be used as the fill or weft yarns in the fill direction F that is transverse to the warp direction W. Further, a plurality of warp yarns can travel in the warp direction W to define and separate the first layer 102 and the second layer 104 and to maintain the first plurality of yarns 106 and the at least one functional yarn 108 in the first layer 102 and to maintain the second plurality of fill yarns 110 in the second layer 104. In the particular embodiment shown in FIG. 1, the plurality of warp yarns can include a first warp yarn 112, a second warp yarn 114, a third warp yarn 116, and a fourth warp yarn 118, etc. that can be used in a repeating fashion. As also shown in FIG. 1, the at least one functional yarn 108 is a fill/weft yarn, although the present disclosure also contemplates that the at least one functional yarn 108 can also be disposed in the warp direction W, or may be used only in the warp direction W.

Although the present disclosure as illustrated in FIG. 1 contemplates the use of a weaving pattern generally known as a "crowfoot" or broken twill, any weaving pattern (e.g., plain, basket, satin, twill, etc.) may be used to form the woven fabric substrate 100 while utilizing the practice of supporting and protecting the functional fiber 108 through use of similar non-functional fill or weft yarns in a secondary or hidden layer.

Figure 2A:
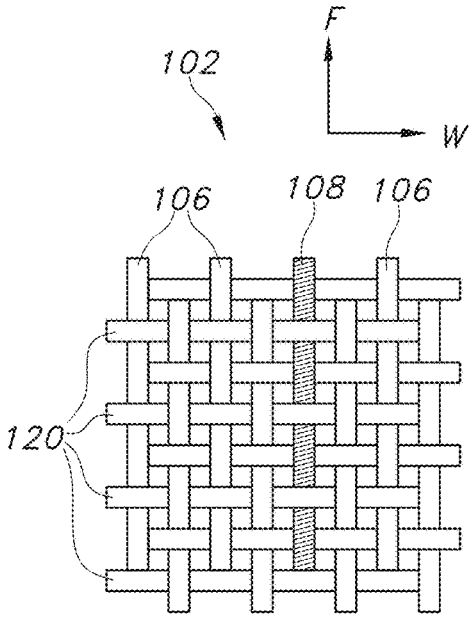
FIG. 2A is a top view of a fabric substrate made in accordance with the present disclosure using a plain weave pattern.
Figure 2B:
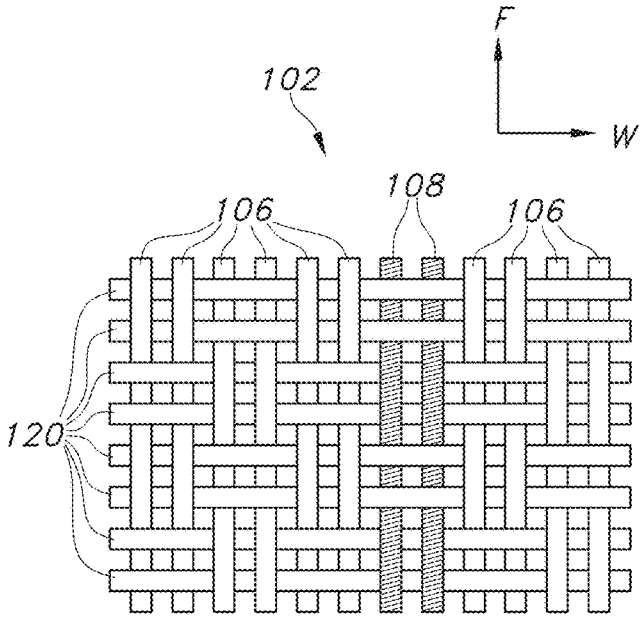
FIG. 2B is a top view of a fabric substrate made in accordance with the present disclosure using a basket weave pattern.
Figure 2C:
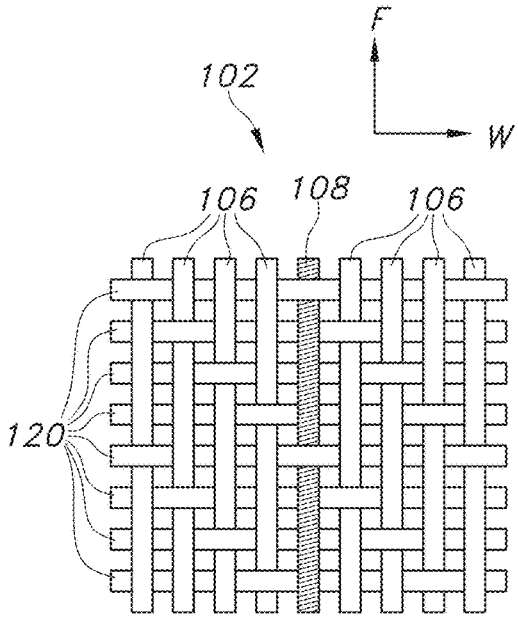
FIG. 2C is a top view of a fabric substrate made in accordance with the present disclosure using a 4-harness satin or crowfoot satin weave pattern.
Figure 2D:
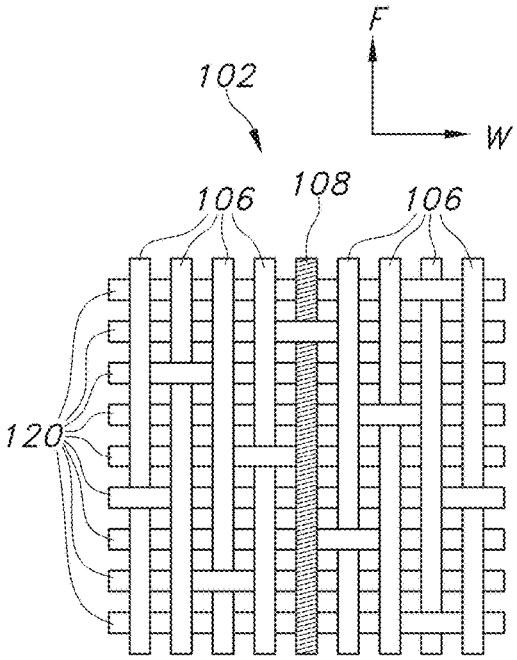
FIG. 2D is a top view of a fabric substrate made in accordance with the present disclosure using a long shaft weave pattern.

FIGS. 2A-2D illustrate examples of particular patterns that may be used. For instance, FIG. 2A is a top view of a fabric substrate made in accordance with the present disclosure using a plain weave pattern, where the warp yarns 120 and the fill yarns 106, including the functional yarn 108, cross over and under one another. Further, FIG. 2B is a top view of a fabric substrate 100 made in accordance with the present disclosure using a basket weave pattern, which is similar to the plain weave pattern of FIG. 2A, where the warp yarns 120 and the fill yarns 106, including two functional yarns 108, cross over and under one another. However, in the basket wave pattern, the warp yarns 120 and the fill yarns 106, including the two functional yarns 108, cross over and under one another in groups of two. Meanwhile, FIG. 2C is a top view of a fabric substrate 100 made in accordance with the present disclosure using a 4-harness satin or crowfoot satin weave pattern, where the fill yarns 106, including the functional yarn 108, each pass over three warp yarns 120 and under one of the warp yarns 120. In addition, FIG. 2D is a top view of a fabric substrate 100 made in accordance with the present disclosure using a long shaft weave pattern.

Figure 3:
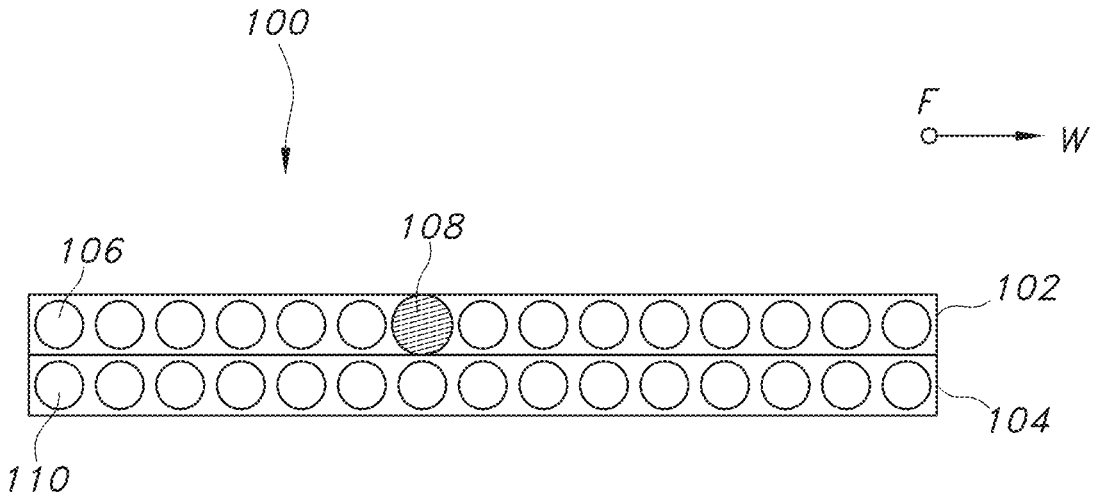
FIG. 3 is a cross sectional view of one embodiment of a two-layer fabric substrate made in accordance with the present disclosure taken along the warp direction showing the various yarns present in the two layers.
Figure 4:
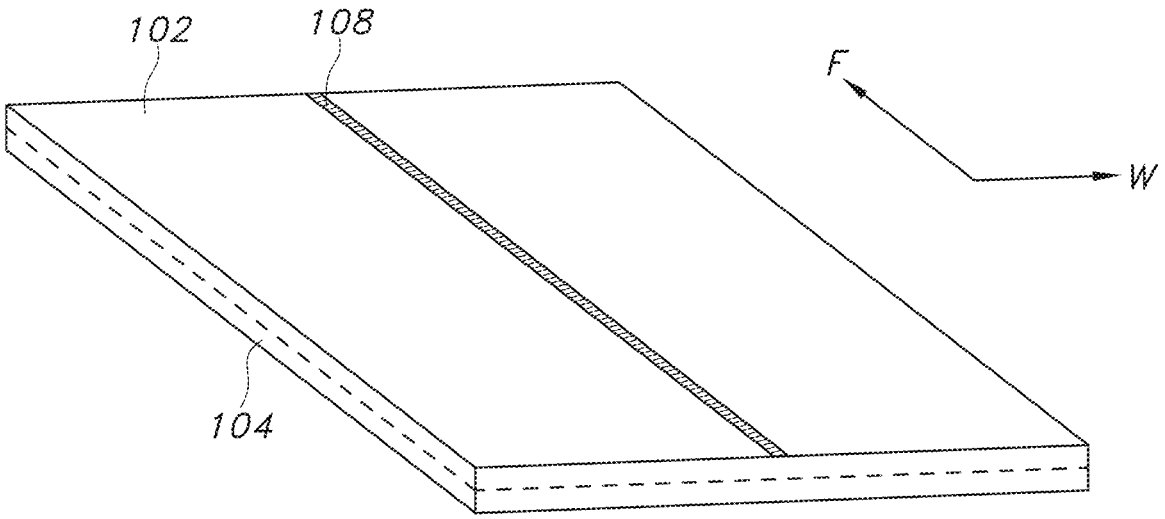
FIG. 4 is a perspective view of the two-layer fabric substrate of FIG. 3.

Referring now to FIG. 3, a cross-sectional view of one embodiment of a two-layer fabric substrate 100 taken along the warp direction W showing the various fill yarns is shown. A first plurality of fill yarns 106 is present in the first layer 102, along with at least one functional yarn 108 in the fill direction F. In addition, a second plurality of fill yarns 110 is present in the second layer 104 in the fill direction F. In addition, a plurality of warp yarns (not shown) run along with warp direction W to maintain separation between the fill yarns present in the first layer 102 and the fill yarns present in the second layer 104 of the fabric substrate 100. A perspective view of the two-layer fabric substrate 100 of FIG. 3 is shown in FIG. 4, where one functional yarn 108 is present in the fill direction F in the first layer 102 of the fabric substrate 100. However, it is also to be understood that more than one or more functional yarns 108 can be present in the fill direction F, and, in some embodiments, the functional yarn or yarns 108 may extend along the warp direction W. In addition, the functional yarn 108 may be present in both the fill direction F and the warp direction W of the first layer 102.

In some embodiments, such as when the fabric substrate 100 is formed into a wearable product, the first layer 102 of the fabric substrate 100 can be the exterior-facing layer, while the second layer 104 can be the body-facing layer. Further, the fabric substrate 100 can include from about 10 picks per inch to about 100 picks per inch, such as from about 20 picks per inch to about 80 picks per inch, such as from about 30 picks per inch to about 70 picks per inch, where the unit of picks per inch refers to the number of fill or weft threads per inch of woven fabric. In addition, the fabric substrate 100 can include from about 10 ends per inch to about 100 ends per inch, such as from about 20 ends per inch to about 80 ends per inch, such as from about 30 ends per inch to about 70 ends per inch, where the unit of ends per inch refers to the number of warp threads per inch of woven fabric.

Referring to FIG. 1 the various features of the first layer 102 and second layer 104 of the fabric substrate 100 will now be discussed in more detail.

First Layer Fill Yarn 106 in First Layer 102

As discussed above, the first layer 102 includes a first plurality of conventional textile weft or fill yarns 106 running in the fill direction F. In one embodiment, the first plurality of fill yarns 106 can include synthetic fibers, such as non-aromatic polyamide fibers (nylon fibers), polyester fibers, polyolefin fibers such as polypropylene fibers, or a combination thereof. In another embodiment, the first plurality of fill yarns 106 in the first layer 102 can be natural fibers such as cotton fibers. In another embodiment, the first plurality of fill yarns 106 in the first layer 102 can be non-aromatic polyamide fibers, polyester fibers, polyolefin fibers, cotton fibers, or a combination thereof.

Regardless of the particular fibers used to form the first plurality of fill yarns 106 in the first layer 102, the first plurality of fill yarns 106 are selected to provide the desired aesthetics and handfeel properties to first layer 102 the fabric substrate 100, which can be the exterior-facing layer of the fabric substrate 100 when the fabric substrate is used to form a product such as an item of apparel. In one particular embodiment, the first plurality of fill yarns can have a linear density ranging from about 1 cotton count (Ne) to about 40 Ne, such as from about 4 Ne to about 30 Ne, such as from about 8 Ne to about 20 Ne. Further, the first plurality of fill yarns can each have a diameter ranging from about 0.05 millimeters (mm) to about 1 mm, such as from about 0.075 mm to about 0.75 mm, such as from about 0.1 mm to about 0.5 mm.

First Layer Functional Yarn 108 in First Layer 102

In addition, the first layer 102 of the fabric substrate 100 also includes at least one functional yarn 108. The functional yarn 108 can be any type of yarn that includes a functional or electronic component. Such components can include a photonic device, a battery, color change, or a combination thereof. In one particular embodiment, the functional or electronic component can include one or more light emitting diodes (LEDs). In another embodiment, the functional component can include functional chemistry (e.g., a component that is capable of undergoing a color change, such as a thermochromic or photochromic component or material). Further, the functional yarn 108 can have any cross-sectional shape. For instance, in some embodiments, the functional yarn can be circular, oval, rectangular, square, triangular, hexagonal, etc.

In one embodiment, the functional yarn 108 can have a diameter ranging from about 0.15 mm to about 1.25 mm, such as from about 0.2 mm to about 1 mm, such as from about 0.25 mm to about 0.75 mm.

Further, because it includes functional or electronic components, or internal connective wires, the functional yarn 108 is relatively stiff, resembling a commercial monofilament yarn comprised of polyester or nylon. For example, the functional yarn 108 can exhibit a compressive resistance ranging from about 145 grams per square millimeter to about 155 grams per square millimeter, such as about 150 grams per square millimeter. A similar non-functional nylon monofilament yarn (e.g., fill yarn 110, present in a second layer of the fabric substrate and discussed in more detail below) can have a compressive resistance ranging from about 125 grams per square millimeter to about 135 grams per square millimeter, such as about 130 grams per square millimeter. Meanwhile, conventional textile fibers such as cotton 106 can have a compressive resistance ranging from about 2.5 grams per square millimeter to about 10 grams per square millimeter, such as about 5 grams per square millimeter. To quantify compressive resistance, force is measured in grams, to linearly compress a 0.25 inch test specimen of fiber. The force value is then normalized according to the cross sectional area of the material. In the proposed embodiment, yarn 106 is flexible and easily compressed, while fill yarn 110 is similarly resistant to compression as compared to functional yarn 108. Therefore, if the overall fabric substrate shrinks, expands, or is otherwise deformed, yarn 110 is present in a sufficient quantity to protect the functional yarn 108, because the yarn 110 and the functional yarn 108 are relatively close in terms of stiffness and resistance to compression. Specific details of the fill yarn 110 are discussed below.

Fill Yarn 110 in Second Layer 104

Because the functional yarn 108 in the first layer 102 is relatively stiff and, as a result, has the tendency to kink or break during or after the formation of the fabric substrate 100 (where shrinkage can occur during the weaving process and/or fabric finishing process) the particular yarn selected for the second plurality of fill yarns 110 in the second layer 104 of the fabric substrate 100 has been chosen to exhibit substantially the same mechanical properties as the functional yarn, 108 to prevent kinking and/or breakage of the functional yarn 106. In one embodiment, the second plurality of fill yarns 110 is selected such that the yarns 110 exhibit substantially the same compressive resistance, flexural strength, or both as the functional yarn 108. For instance, the compressive resistance of the second plurality of fill yarns 110 can be from about 70% to about 110%, such as from about 75% to about 100%, such as from about 80% to about 95% of the compressive resistance of the functional yarn 108, but the quantity of the second plurality of fill yarns 110 is large enough to collectively prevent damage to functional yarn 108 in the event of deformation of the final fabric. Likewise, the flexural strength of the second plurality of fill yarns 110 can be from about 70% to about 110% of the flexural strength of the functional yarn 106, such as from about 75% to about 100% of the flexural strength of the functional yarn 106, such as from about 80% to about 95% of the flexural strength of the functional yarn 106.

In one embodiment, the second plurality of fill yarns 110 can be monofilament yarns. Further, the monofilament yarn can include nylon, polyethylene, polyester, metallic wire, ultrahigh molecular weight polyethylene, polyvinylidene fluoride, polyester, or a combination thereof, or any material of suitable diameter and compressive resistance.

In another embodiment, the monofilament yarns used to form the second plurality of fill yarns 110 can be covered with a textile fiber. For instance, the monofilament yarns can be covered with non-aromatic polyamide fibers, polyester fibers, polyolefin fibers, cotton fibers, or a combination thereof. However, when the monofilament yarns are covered, it is to be understood that the second plurality of fill yarns 110 still maintain substantially similar mechanical properties (e.g., compressive resistance, flexural strength, etc.) compared to the functional yarn 108 to prevent kinking and/or breakage of the functional yarn 108.

In addition, in one embodiment, the second plurality of fill yarns 110 can each have a diameter ranging from about 0.15 mm to about 1.25 mm, such as from about 0.2 mm to about 1 mm, such as from about 0.25 mm to about 0.75 mm. Moreover, the ratio of the diameter of the functional yarn 108 to one of the second plurality of fill yarns 110 can range from about 1.0 to about 1.2, such as from about 1.025 to about 1.15, such as from about 1.05 to about 1.1.

Warp Yarn

As described above, the first layer 102 and second layer 104 of the fabric substrate 100 can include a plurality of warp yarns 120 that run along the warp direction W to maintain and hold the first plurality of fill yarns 106 and the functional yarn 108 in the first layer 102 and to maintain and hold the second plurality of fill yarns 110 in the second layer 104. Although any suitable yarn or combination of yarns may be used for the warp yarn 120 (or the warp yarns 112, 114, 116, and 118 as shown in FIG. 1), in one embodiment, the warp yarns can include a sheath and a core. For instance, the core can include a glass filament, a monofilament, carbon fibers, or polyester fibers, while the sheath can include non-aromatic polyamide fibers, polyester fibers, polyolefin fibers, cotton fibers, or a combination thereof.

Regardless of the particular material or materials used to form the warp yarns 112, 114, 116, 118, and 120 of the fabric substrate 100, the warp yarns can have a linear density ranging from about 1 cotton count (Ne) to about 20 Ne, such as from about 2 Ne to about 15 Ne, such as from about 3 Ne to about 10 Ne. Further, the warp yarns can have a diameter ranging from about 0.05 mm to about 1.25 mm, such as from about 0.075 mm to about 1 mm, such as from about 0.1 mm to about 0.75 mm. Further, the first plurality of fill yarns can each have a diameter ranging from about 0.05 millimeters (mm) to about 1 mm, such as from about 0.075 mm to about 0.75 mm, such as from about 0.1 mm to about 0.5 mm.

Products

The fabric substrate 100 with functional yarn 108 as described above can be used to form a wide variety of textile products such as garments, protective wear, or end uses where the products are comfortable for the wearer despite the inclusion of the functional yarn 108 in the woven fabric, where the functional yarn can, for example, enhances the visibility of the wearer at night or in other situations where visibility is low or where functional fiber 108 adds a significant performance characteristic that is otherwise unavailable.

In some embodiments, the fabric product can be used to form a protective, automotive, industrial (e.g., belting), construction, roofing, medical, or carpeting product.

In one particular embodiment, the fabric substrates of the present disclosure can be used to make apparel and other garments. Such apparel can include jackets, shirts, coats, pants, bib overhauls, gloves, hats, face shields, socks, shoes, boots and the like. The fabric can be used to form an entire article of clothing or can be used to form a certain component or panel of the clothing. For instance, the fabric can be used as leg fabric for a pair of pants. In still another embodiment, the fabric can be used to produce the entire garment.

For exemplary purposes only, various examples of apparel that may be made from the fabric substrate 100 in accordance with the present disclosure are illustrated in FIGS. 5A through 7C.

Figure 5A:
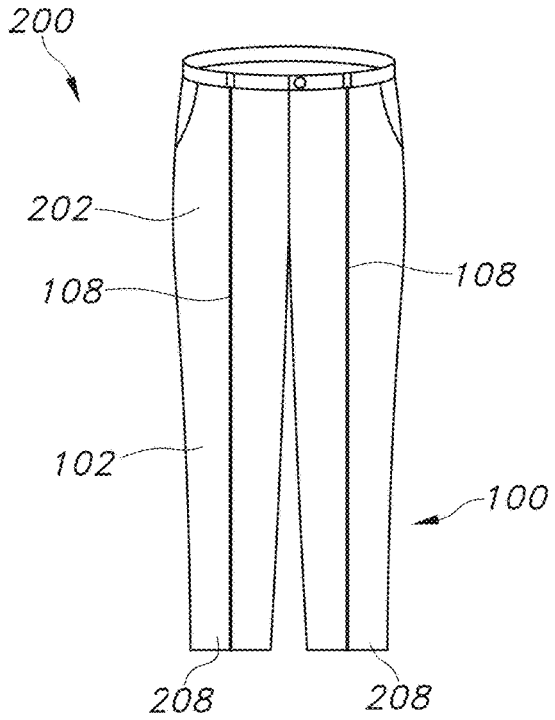
FIG. 5A is a front view of one embodiment of a garment made in accordance with the present disclosure.
Figure 5B:
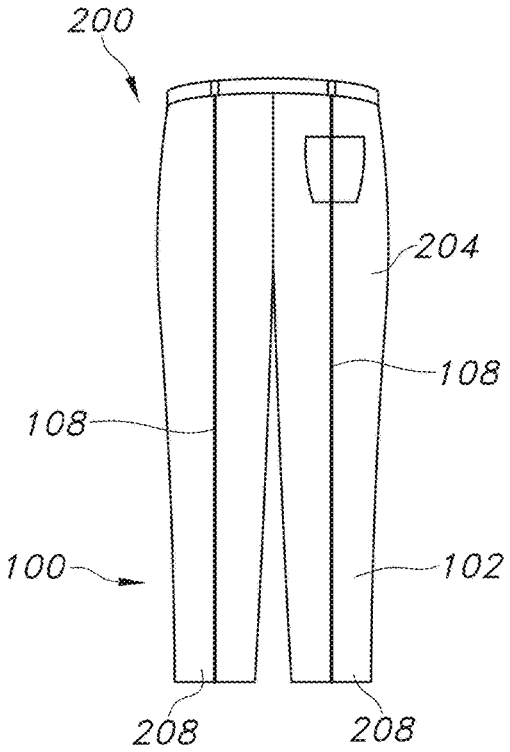
FIG. 5B is a rear view of the garment of FIG. 5A.
Figure 5C:
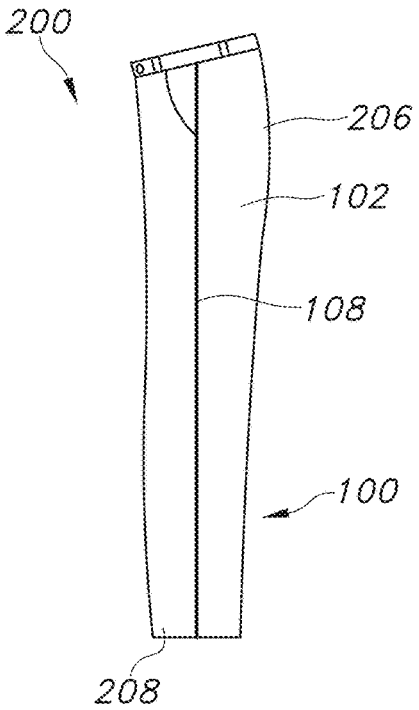
FIG. 5C is a side view of the garment of FIG. 5A.

FIGS. 5A-5C, for instance, illustrate a pair of pants 200. As shown in FIGS. 5A-5C, the pants 200 are formed from the fabric substrate 100 of the present disclosure, where the first layer 102 of the fabric substrate 100 (e.g., the exterior-facing layer 102) can include one or more functional yarns 108. Referring to FIG. 5A, in one embodiment, the one or more functional yarns 108 can be present on the front 202 of the pants 200, such as on one or both pants legs 208. In another embodiment and referring to FIG. 5B, the one or more functional yarns 108 can be present on the back 204 of the pants 200, such as on one or both pants legs 208. In still another embodiment and referring to FIG. 5C, the one or more functional yarns 108 can be present on the side 206 of the pants 200, such as on one or both pants legs 208.

Figure 6A:
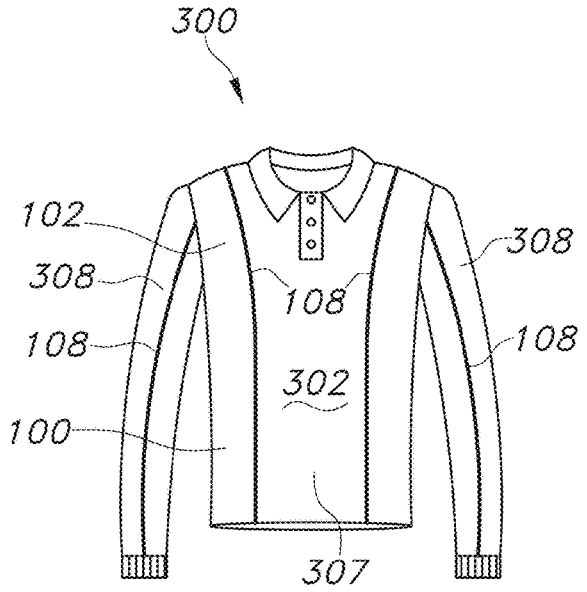
FIG. 6A is a front view of another embodiment of a garment made in accordance with the present disclosure.
Figure 6B:
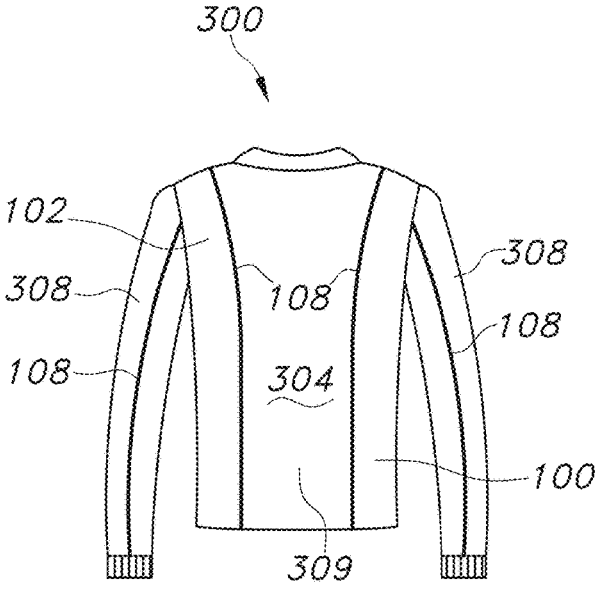
FIG. 6B is a rear view of the garment of FIG. 6A.
Figure 6C:
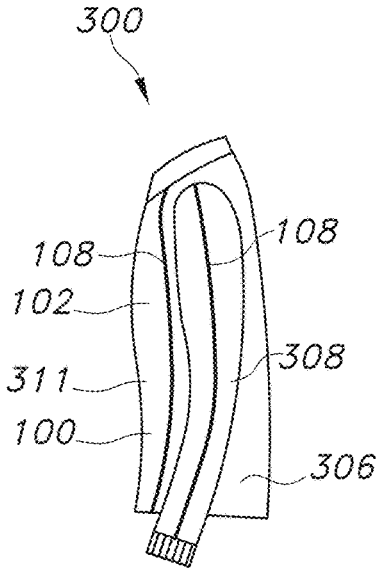
FIG. 6C is a side view of the garment of FIG. 6A.

FIGS. 6A-6C, for example, illustrate a shirt 300. As shown in FIGS. 6A-6C, the shirt 300 is formed from the fabric substrate 100 of the present disclosure, where the first layer 102 of the fabric substrate 100 (e.g., the exterior-facing layer 102) can include one or more functional yarns 108. Referring to FIG. 6A, in one embodiment, the one or more functional yarns 108 can be present on the front 302 of the shirt 300, such as on one or both sleeves 308 and/or on the front panel 307. In another embodiment and referring to FIG. 6B, the one or more functional yarns 108 can be present on the back 304 of the shirt 300, such as on one or both sleeves 308 and/or on the back panel 309. In still another embodiment and referring to FIG. 6C, the one or more functional yarns 108 can be present on the side 306 of the shirt 300, such as on one or both sleeves 308 and/or on a side panel 311.

Figure 7A:
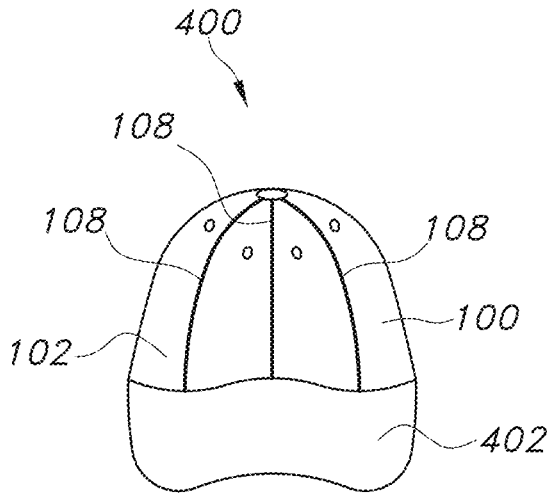
FIG. 7A is a front view of yet another embodiment of a garment made in accordance with the present disclosure.
Figure 7B:
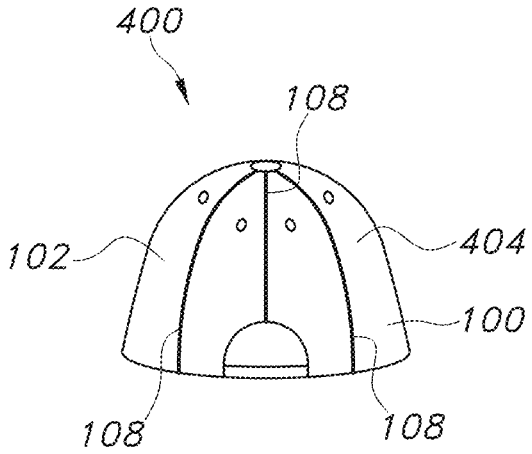
FIG. 7B is a rear view of the garment of FIG. 7A.
Figure 7C:
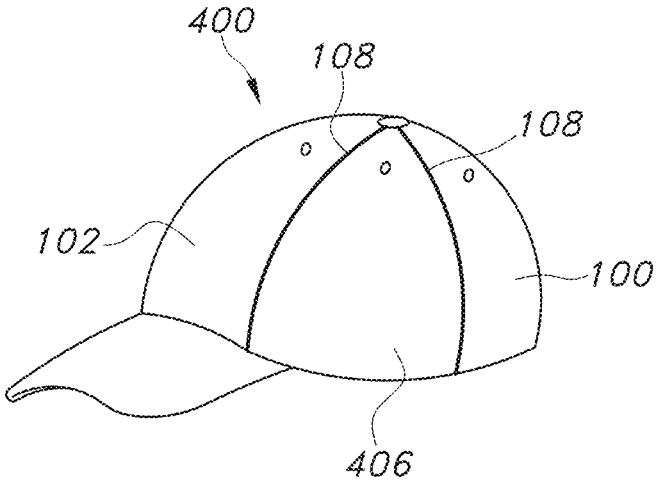
FIG. 7C is a side view of the garment of FIG. 7A.

FIGS. 7A-7C, for instance, illustrate a hat 400. As shown in FIGS. 7A-7C, the hat 400 is formed from the fabric substrate 100 of the present disclosure, where the first layer 102 of the fabric substrate 100 (e.g., the exterior-facing layer 102) can include one or more functional yarns 108. Referring to FIG. 7A, in one embodiment, the one or more functional yarns 108 can be present on the front 402 of the hat 400. In another embodiment and referring to FIG. 7B, the one or more functional yarns 108 can be present on the back 404 of the hat. In still another embodiment and referring to FIG. 7C, the one or more functional yarns 108 can be present on the side 406 of the hat 400.

The present invention may be better understood with reference to the following examples.

EXAMPLE

Figure 8:
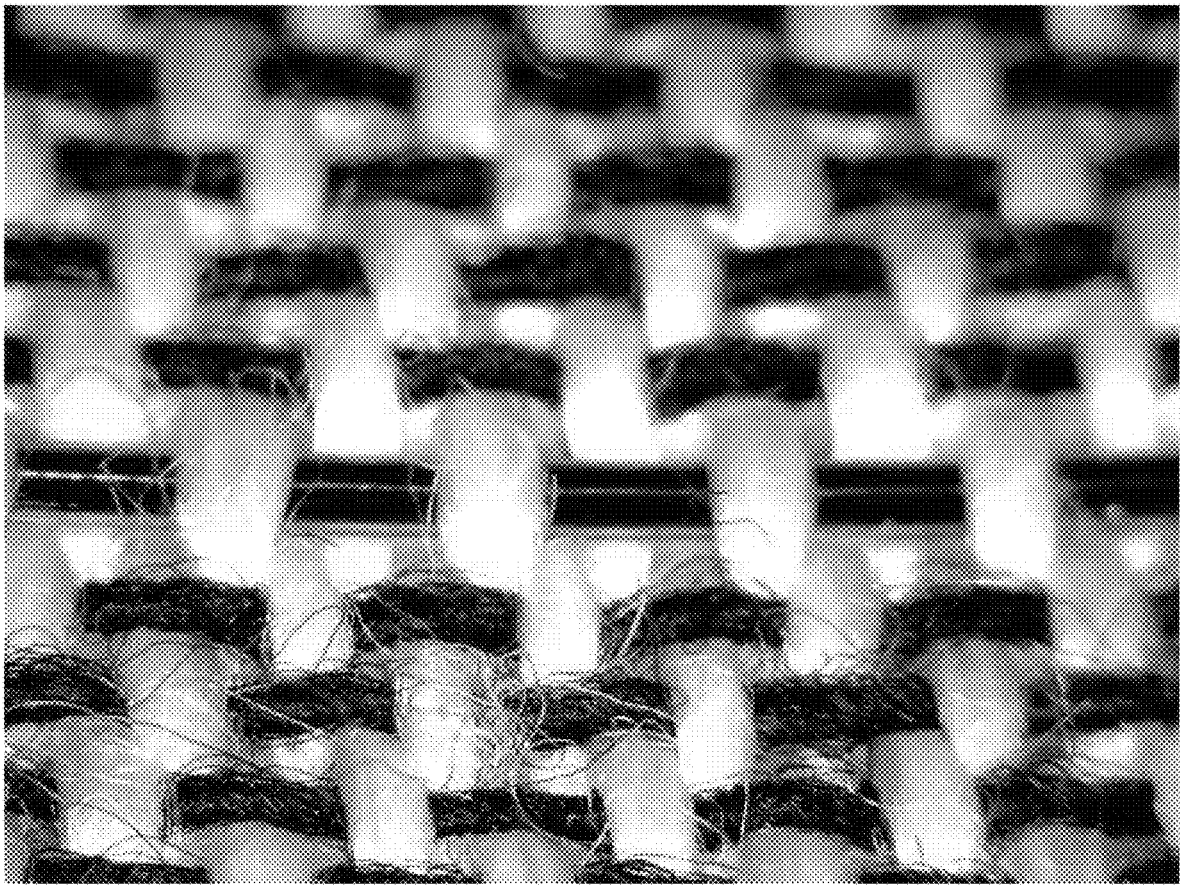
FIG. 8 is a photograph of a fabric substrate that includes a first layer and second layer as contemplated by the present disclosure, where the functional yarn component is undamaged and functional.
Figure 9:
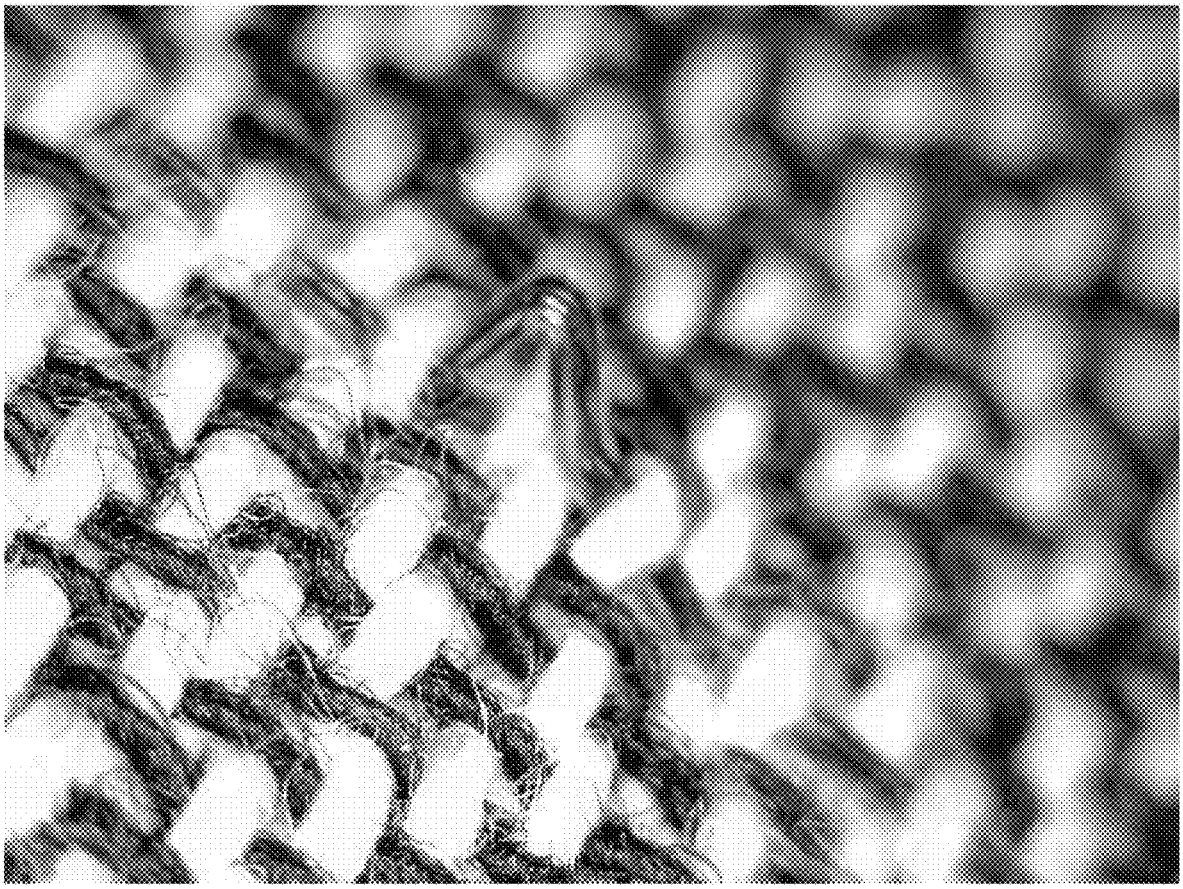
FIG. 9 is a photograph of a fabric substrate that includes a second layer that is not contemplated by the present disclosure, where the functional yarn component exhibits kinking and bending and has in effect become non-conductive and non-functional, where it is to be understood that FIGS. 8 and 9 show woven textile fabrics that are identical, except that woven textile fabric in FIG. 8 contains the described layer of non-functional reinforcing yarns that are physically similar to the functional yarn in terms of resistance to compression and bending.

The following example fabric was produced and previously illustrated in FIGS. 8 and 9. The base fabric shown in these two figures is a double layer construction that corresponds to drawing FIG. 1. This material incorporates 57 warp threads per linear inch of width, and 50 weft threads per inch of length. The warp yarn 112 through 118 is white in color. The non-functional face weft yarn 106 is black in color. The functional face yarn 108 appears as a clear monofilament with a visible core in layer 102. The fabric material in FIG. 8 contains a bottom layer of reinforcing monofilament nylon of 0.37 mm diameter nylon, situated as yarn 110 in layer 104. Yarn 110 and yarn 108 have a similar resistance to compression, and therefore in FIG. 8, no kinking or distortion to functional fiber 108 is found. In FIG. 9, the functional yarn 108 shows unwanted damage and distortion. The only difference between FIG. 8 and FIG. 9 is that in FIG. 9, the monofilament reinforcement layer 104 has been replaced with conventional textile yarn 106. In effect, conventional yarn 106 cannot prevent damage to functional yarn 108, because yarn 106 has a very low resistance to linear deformation.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A fabric substrate comprising:

a first layer, wherein the first layer includes a first plurality of fill yarns and at least one functional fill yarn, wherein the at least one functional yarn contains a functional or electronic component, wherein the functional or electronic component comprises a photonic device, a battery, a light emitting diode, or a combination thereof; and a second layer, wherein the second layer includes a second plurality of fill yarns, wherein the second plurality of fill yarns and the at least one functional fill yarn exhibit substantially the same compressive strength or resistance, flexural strength, or both;

wherein a plurality of warp yarns maintain the first plurality of fill yarns and the at least one functional fill yarn in the first layer and maintain the second plurality of fill yarns in the second layer, wherein the first layer is separated from the second layer.

2. A fabric substrate as defined in claim 1, wherein the compressive strength or resistance of the second plurality of fill yarns is from about 70% to about 110% of the compressive strength of the at least one functional fill yarn.

3. A fabric substrate as defined in claim 1, wherein the flexural strength of the second plurality of fill yarns is from about 70% to about 110% of the flexural strength of the at least one functional yarn.

4. A fabric substrate as defined in claim 1, wherein the first plurality of fill yarns each have a diameter ranging from about 0.05 millimeters to about 1 millimeter.

5. A fabric substrate as defined in claim 1, wherein the first plurality of fill yarns each comprise non-aromatic polyamide fibers, polyester fibers, polyolefin fibers, cotton fibers, or a combination thereof.

6. A fabric substrate as defined in claim 1, wherein the second plurality of fill yarns each have a diameter ranging from about 0.05 millimeters to about 1 millimeter.

7. A fabric substrate as defined in claim 1, wherein the second plurality of fill yarns each comprise a monofilament.

8. A fabric substrate as defined in claim 7, wherein the monofilament is nylon, polyethylene, ultrahigh molecular weight polyethylene, polyvinylidene fluoride, polyester, or a combination thereof.

9. A fabric substrate as defined in claim 7, wherein the monofilament is covered with a textile fiber.

10. A fabric substrate as defined in claim 1, wherein a ratio of a diameter of the at least one functional yarn to each of the second plurality of fill yarns ranges from about 1.0 to about 1.2.

11. A fabric substrate as defined in claim 1, wherein the plurality of warp yarns each have a diameter ranging from about 0.05 millimeters to about 1 millimeter.

12. A fabric substrate as defined in claim 11, wherein each of the plurality of warp yarns comprises a sheath and a core, wherein the sheath comprises non-aromatic polyamide fibers, polyester fibers, polyolefin fibers, cotton fibers, or a combination thereof, and wherein the core comprises a glass filament, a monofilament, carbon fibers, or polyester fibers.

13. A fabric substrate as defined in claim 1, wherein the first layer is an exterior-facing layer and the second layer is a body-facing layer.

14. A fabric product comprising the fabric substrate defined in claim 1.

15. The fabric product as defined in claim 14, wherein the fabric product is an item of apparel.

16. The fabric product as defined in claim 14, wherein the fabric product is a protective, automotive, industrial, medical, construction, or carpeting product.

17. A fabric substrate as defined in claim 1, wherein the at least one functional yarn has a diameter ranging from about 0.15 millimeters to about 125 millimeters.

* * * * *